US007574997B1

(12) United States Patent
Chauza et al.

(10) Patent No.: US 7,574,997 B1
(45) Date of Patent: Aug. 18, 2009

(54) MOBILE ENGINE PERFORMANCE DEMONSTRATION UNIT

(76) Inventors: Roger N. Chauza, 908 Meadow Creek Dr., Apt. 4076, Irving, TX (US) 75038; Brenda H. Borchelt, 908 Meadow Creek Dr., Apt. 4076, Irving, TX (US) 75038

( * ) Notice: Subject to any disclaimer, the term of this patent is extended or adjusted under 35 U.S.C. 154(b) by 952 days.

(21) Appl. No.: 10/686,915

(22) Filed: Oct. 16, 2003

Related U.S. Application Data

(60) Provisional application No. 60/418,738, filed on Oct. 16, 2002.

(51) Int. Cl.
*F02M 33/00* (2006.01)

(52) U.S. Cl. ..... 123/538

(58) Field of Classification Search ..... 123/536–539, 123/549, 557, 541; 73/116–117
See application file for complete search history.

(56) References Cited

U.S. PATENT DOCUMENTS

| | | | | | |
|---|---|---|---|---|---|
| 4,367,143 | A | | 1/1983 | Carpenter | |
| 4,779,705 | A | | 10/1988 | Verdin | |
| 4,932,628 | A | * | 6/1990 | Pacheco | 248/676 |
| 5,070,852 | A | * | 12/1991 | Po et al. | 123/538 |
| 5,124,045 | A | * | 6/1992 | Janczak et al. | 210/695 |
| 5,159,915 | A | * | 11/1992 | Saito et al. | 123/557 |
| 5,219,399 | A | * | 6/1993 | Brana | 123/557 |
| 5,331,807 | A | * | 7/1994 | Hricak | 60/275 |
| 5,452,578 | A | | 9/1995 | Barber | |
| 5,515,712 | A | * | 5/1996 | Yunick | 73/9 |
| 5,637,226 | A | * | 6/1997 | Adam et al. | 210/695 |
| 5,716,520 | A | * | 2/1998 | Mason | 210/222 |
| 5,736,104 | A | | 4/1998 | Oh et al. | |
| 5,739,413 | A | | 4/1998 | Kohn et al. | |
| 5,851,007 | A | * | 12/1998 | Swartzlander et al. | 269/17 |
| 6,000,382 | A | * | 12/1999 | Albisetti | 123/538 |
| 6,029,508 | A | * | 2/2000 | Schoenbeck et al. | 73/116 |
| 6,183,700 | B1 | | 2/2001 | Jeong | |
| 6,220,231 | B1 | * | 4/2001 | Kobayashi | 123/538 |
| 6,253,600 | B1 | * | 7/2001 | Sondey | 73/116 |
| 6,286,307 | B1 | | 9/2001 | Feeny et al. | |
| 6,332,965 | B1 | | 12/2001 | Sugiyama et al. | |
| 6,372,120 | B1 | | 4/2002 | Rossler et al. | |
| 6,386,187 | B1 | * | 5/2002 | Phykitt | 123/538 |
| 6,391,267 | B1 | | 5/2002 | Martin et al. | |

(Continued)

FOREIGN PATENT DOCUMENTS

JP 2001341552 A * 12/2001

OTHER PUBLICATIONS

Thunder Racing—Exhaust Cut-Outs, website advertising, 2 pages.

(Continued)

*Primary Examiner*—M. McMahon
(74) *Attorney, Agent, or Firm*—Roger N. Chauza, PC

(57) ABSTRACT

An engine mounted for mobile movement. The engine has associated therewith aftermarket apparatus which can be switched in and out of operation with respect to the engine. Various sensors sense respective engine operating parameters which are displayed on visual displays. Observers can thus visually see the difference in operation of the engine with the aftermarket switched into operation, and switched out of operation.

22 Claims, 3 Drawing Sheets

U.S. PATENT DOCUMENTS

| | | | | |
|---|---|---|---|---|
| 6,415,602 | B1 | 7/2002 | Patchett et al. | |
| 6,450,155 | B1 | 9/2002 | Arkfeld | |
| 6,453,663 | B1 | 9/2002 | Orzel et al. | |
| 6,584,767 | B1 | 7/2003 | Koenig | |
| 6,596,163 | B1 * | 7/2003 | Parker | 210/222 |
| 6,625,504 | B2 * | 9/2003 | Landreth | 700/83 |
| 6,637,537 | B2 | 10/2003 | Porter et al. | |
| 6,849,188 | B2 * | 2/2005 | Sacs | 210/695 |
| 6,901,917 | B2 * | 6/2005 | Muller | 123/536 |
| 2003/0005913 | A1 * | 1/2003 | Shelor et al. | 123/541 |

OTHER PUBLICATIONS

JC Whitney, 3" Aluminized Exhaust Cutout, website advertising, 2 pages.
JC Whitney, Cast-Iron Exhaust Cutout, website advertising, 1 page.
JC Whitney, Electric Exhaust Cutouts, website advertising, 1 page.
Installation Instructions for Electric Exhaust Cutout, buickgn.com website advertising, 3 pages.

* cited by examiner 140
130
148
142
TO FUEL INJECTION SYSTEM
FROM FUEL PUMP/TANK
154
152
134
S
S
144
132
136
138
150
146
158
RPM
AUTO SPEED
AUTO LOAD
ON BOARD COMPUTER
DRIVE CIRCUIT
156
ENGINE PERFORMANCE PARAMETERS

MOBILE ENGINE PERFORMANCE DEMONSTRATION UNIT

RELATED APPLICATION

This non-provisional patent application claims the benefit of pending U.S. provisional patent application filed Oct. 16, 2002, and assigned Ser. No. 60/418,738, the subject matter of which is fully incorporated herein by reference.

BACKGROUND OF THE INVENTION

Engines powered by hydrocarbon fuels are used in almost every automobile, aircraft, boat and industrial internal combustion engines. Insofar as such type of fuels are of a limited resource, there is a continued effort to improve the efficiency of the use of the fuels in engines. When new developments are made to improve the engine performance as a function of the amount of fuel used, less of the hydrocarbon resource is used and the engines operate in a more cost effective manner.

In addition, improvements continue to be made to engines and engine apparatus to reduce the undesirable emissions and thus improve the quality of the environment. Computerized emission controls, catalytic converters and other apparatus are standard apparatus used on engines to reduce the undesirable emissions.

Many types of aftermarket apparatus are available to improve engine performance, both as to fuel efficiency and reduction of the hydrocarbon content emitted from the exhaust. The sales of such apparatus depends on the exposure to the public of the apparatus, such as advertising, as well as the reputation of the apparatus developed in connection with its actual use. As with many consumer items, the purchase of the same involves convincing the consumer that the item is cost effective and functions in the manner claimed. As noted above, the standard way to expose consumers to the aftermarket apparatus is by advertisement, word of mouth and testimonials. While this is somewhat effective, it would be extremely beneficial if consumers could visually see the benefits of the operational characteristics of the aftermarket apparatus under actual working conditions.

SUMMARY OF THE INVENTION

In accordance with an important aspect of the invention, there is disclosed a mobile operational engine equipped with the aftermarket apparatus for use under actual working conditions. In addition, the engine is equipped with apparatus for switching the aftermarket apparatus in and out of operation to show the change in efficiency of the operation of the engine. Further included are a number of gauges for showing the operational parameters of the engine when the aftermarket apparatus is switched into operation and out of operation. Various monitors are connected to the exhaust system to also show the change in emissions which corresponds to the use of the aftermarket apparatus. A fuel flow gauge is coupled to the fuel line to monitor the fuel flow when the aftermarket apparatus is switched into and out of operation. The engine can be equipped with a load that can be varied to vary the performance parameters of the engine. A catalytic converter can be switched into and out of operation so that the engine emissions can be monitored to verify the effectiveness of the aftermarket apparatus.

In accordance with another aspect of the invention, a programmed processor can be provided to monitor the various engine performance parameters and present the same on visual displays. The programmed processor can also be coupled to control apparatus for controlling the switching of the engine apparatus, such as a fuel line switch, a catalytic converter switch and an engine load clutch or switch. The programmed processor can be programmed to respond to a particular engine configuration input thereto by an observer, and configure the engine apparatus accordingly. The processor can be programmed with a number of routines corresponding to different engine configurations, so that the engine apparatus can be configured to operate according to the configuration input by the observer. The engine configurations can be static or dynamic. The static engine configurations can remain in place until reconfigured by an observer, or after a predefined period of time, whereupon the next programmed engine configuration is automatically placed into effect. The processor can also be programmed to control the engine apparatus in a dynamic manner so that various apparatus is changed dynamically, such as engine speed, engine load, etc. In other words, during a dynamic configuration, the load on the engine may be increased at a predetermined rate over a period of time, where the performance parameters are monitored and presented on visual displays or graphically.

In accordance with another feature of the invention, there is disclosed a switch mechanism for switching into operation and out of operation an aftermarket apparatus with respect to a fuel line. The switch mechanism is pivotal about an axis, and has hinged segments movable by a handle. Each segment is structured to hold a magnet assembly thereto. Once the magnet assemblies are attached to the switch mechanism, the handle is rotated about the fuel line so that the segments of the switch mechanism wrap around the fuel line. In this manner, the magnet assemblies are spaced around the fuel line and held in contact therewith. The magnet assemblies can then influence the fuel that flows through the fuel line.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
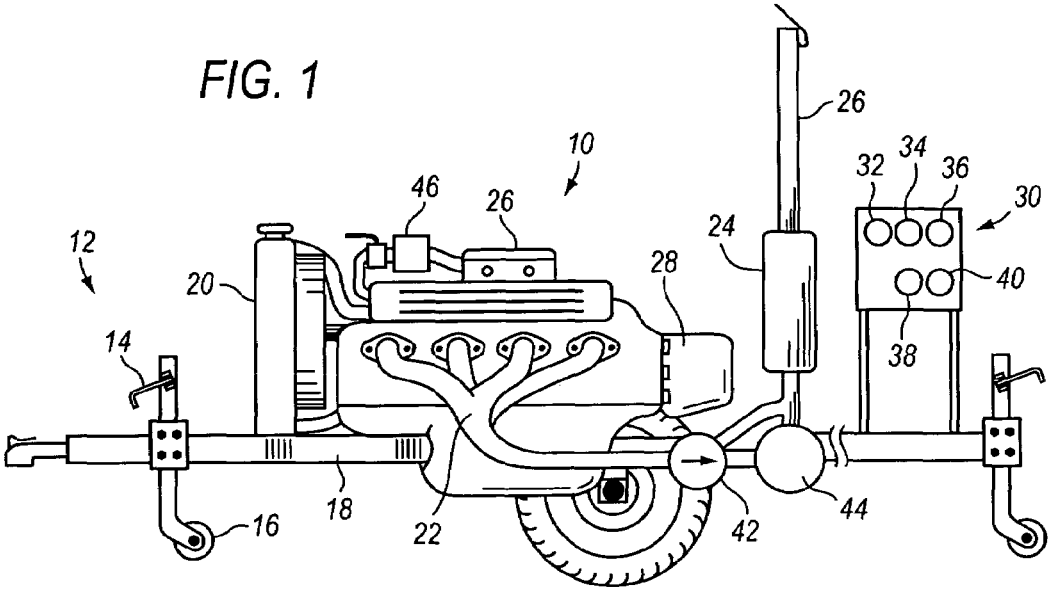
FIG. 1 is a side view of the engine performance apparatus according to one embodiment of the invention.

FIG. 1 illustrates the mobile engine performance demonstration unit according to one embodiment of the invention. An internal combustion engine 10 is mounted on a two-wheeled trailer 12 for purposes of mobility. The trailer 12 can be of conventional design. For ease of understanding the structure and operation of the invention, one of the two wheels is not shown, and only a portion of the frame 18 is shown. The trailer 12 includes a screw-type jack 14 with a bottom-mounted wheel 16 to support the front part of the trailer 12 when unhooked from a towing vehicle. The demonstration unit can thus be transported to various sites for demonstration of the performance of the engine 10 as a function of the aftermarket apparatus. Indeed, the engine performance apparatus is well adapted for demonstration at gatherings of consumers and auto enthusiasts, such as at racing events, state fairs, auto shows, auto parts stores, state emissions testing centers, service stations, auto auctions, etc.

While the engine 10 is shown as an auto engine, the engine could as well be an airplane engine, boat engine, a jet engine, a diesel or natural gas operated engine, a smaller one or two cylinder engine, etc. The engine is mounted to a frame 18 of the trailer 12 by way of standard motor mounts. The engine 10 is connected to the standard engine apparatus that is necessary to allow the engine to operate, such as a radiator 20, an exhaust system 22 coupled to a muffler 24 and an exhaust pipe 26. Also included, but not shown, is a fuel system including a fuel tank and a fuel pump for pumping the fuel to a carburetor 26 or fuel injection system. Further included is a starter, a battery for starting the engine 10, and a throttle for controlling the speed of the engine 10. The throttle is preferably of the type where the engine speed can be manually or automatically set to any desired RPM. The foregoing is standard engine equipment. Depending on the aftermarket apparatus to be demonstrated, the engine 10 may be a used engine with substantial mileage, or may be a new engine.

Coupled to the crankshaft or flywheel of the engine 10 is a dynamic load 28, which may be a hydraulic load, a dynamometer or other loading device for placing a load on the crankshaft of the engine 10. Also included is a switch mechanism (not shown) for switching the dynamic load 28 into and out of operation with respect to the engine 10. The load switch mechanism can be a standard clutch-type of mechanism. The clutch in combination with the load can also be of the type for placing a variable load on the engine 10.

A panel 30 is attached either to the frame 18 of the trailer 12 or to the engine 10. Mounted to the panel 30 are a number of gauges to visually observe the operational parameters of the engine 10. In particular, an RPM gauge 32 is mounted to the panel 30; a fuel flow gauge 34 is mounted to the panel 30; a carbon dioxide readout gauge 36 is mounted to the panel 30; a nitrogen oxide (NOx) gauge 38 is mounted to the panel 30, and a speedometer 40 is mounted to the panel 30. These readout gauges are for the benefit of observers to see the different results of the aftermarket apparatus when switched into and out of operation with respect to the engine 10.

The RPM gauge 32 is connected to a conventional sender for converting the rotational movement of the engine crankshaft to an electrical signal which registers the RPM on the gauge 32. The fuel flow gauge 34 is connected to a fuel flow measurement device which provides an accurate measurement of the flow rate of the fuel used by the engine 10 during operation thereof. The fuel flow gauge 34 provides a visual reading of the amount of fuel used by the engine 10 with and without the use of the aftermarket apparatus. In like manner, the emission gauges 36 and 38 are coupled to appropriate senders mounted in the exhaust system of the engine 10 to provide visual readouts of the emissions output by the engine 10 during operation of the aftermarket apparatus, and without the aftermarket apparatus. The speedometer 40 is responsive to the RPM of the engine 10, but is calibrated to register what the speed of a vehicle would be if proceeding down a highway during cruise speed. Other gauges can be mounted to the panel to provide visual indications of the operation of the aftermarket apparatus.

While gauges with needles are shown in FIG. 1, other types of visual indicators can be used. For example, bar graph type and digital readouts can be used instead of the needle gauges. The electronics that receive the various indications of the operation of the engine 10 can be of the conventional type for driving the bar graphs. Indeed, each engine performance parameter can be used to drive two bar graphs, one bar graph for indicating the engine performance operating with the aftermarket apparatus, and the other bar graph to indicate the engine performance without the aftermarket apparatus. In this instance, the electronics would be designed to maintain the respective indication (such as engine operation without the use of the aftermarket apparatus), even though the aftermarket apparatus has been switched into operation. In this manner, the observer can simultaneously observe the before and after operation of the aftermarket apparatus. Stated another way, and using the emission hydrocarbons (HC) as an engine operating parameter, the observer could observe on one bar graph readout the parts per million (PPM) of hydrocarbons emitted by the engine configured without the aftermarket apparatus, and simultaneously observe on the other bar graph readout the PPM of hydrocarbons presently being emitted in the emissions with the aftermarket apparatus switched into operation. The side-by-side visual readouts of the various engine performance parameters would be easily understood and convincing to the observer. Rather than using dual bar graphs for presenting a before and after engine performance parameter, dual digital numerical readouts can be used.

The exhaust manifolds 22 of the engine 10 are coupled to a switch 42 for switching the exhaust gasses from the engine 10 to either a catalytic converter 44, or directly to the muffler 24 to thereby bypass the catalytic converter 44. With this arrangement, the engine performance parameters can be observed on the gauges mounted to the panel 30 with and without the use of the catalytic converter 44.

In accordance with an important feature of the invention, there is provided an aftermarket fuel conditioner 46 that can be switched into and out of operation with respect to the engine 10. The aftermarket apparatus is shown in more detail in FIG. 2. The fuel conditioner 46 can be of the many types that are advertised or marketed, such as that disclosed in U.S. Pat. Nos. 4,568,901 entitled "Magnetic Fuel Ion Modifier," 6,450,155 entitled "In-Line Fuel Conditioner," or any other type of fuel, oil or air intake conditioner.

A fuel line 48 is extended from the fuel tank and fuel pump (not shown), preferably of the electric type. The fuel line 48 is connected to a fluid flow sensor 50 of the type that can accurately measure the flow rate of the fuel passing through the fuel line 48. Such types of flow sensors are readily available. One flowmeter is shown in U.S. Pat. No. 6,397,686. The output of the flow sensor 50 is coupled to the electronics driving the fuel flow gauge 34 mounted to the panel 30. The output of the fuel flow sensor 50 is coupled to a fuel switch 52. The fuel switch 52 can be of the manually-operated type, or of the electrically-operated type. One output port 54 of the fuel switch 52 is coupled to the fuel conditioner 46. If the fuel conditioner 46 is of the type which fits around the fuel line, then it can be mounted around the line that is coupled to the output port 54 of the fuel switch 52. If circumstances require, the fuel line, or portions thereof, can be constructed from a non-ferrous material or a synthetic material to prevent interference with the magnetic field of magnets. If the fuel conditioner 46 is of the type where the fuel line must be broken, then it can be connected in the fuel line 54 with the appropriate fittings. The down stream portion 56 of the fuel line is formed as a "Y" branch, where a first portion 58 of the fuel line and a second portion 60 of a fuel line come together into a common fuel line 62. The downstream fuel line 62 is coupled to the carburetor 26 or fuel injection system. The second fuel line portion 60 is connected to the second outlet port 64 of the fuel switch 52.

If necessary, portions of the fuel line can be made of a nonmetallic material, a non-ferrous material, a transparent material, or other type of material that accentuates the operation or visual effect of the aftermarket apparatus 46.

As yet another option for demonstrating the advantages of the aftermarket apparatus 46, multiple fuel tanks can be employed, with a different fuel in each such tank, e.g. a low, medium and high octane fuel. The output of each fuel tank can be switched manually or automatically to the fuel line 48 by respective switches (not shown). In this manner, different fuels can be conveniently coupled to the engine via the aftermarket apparatus 46 and the results visually displayed accordingly. The demonstration apparatus can be configured to show that with the use of a low octane fuel and the aftermarket apparatus 46, the performance of the engine 10 is the same or better than with the use of a higher octane fuel without the aftermarket apparatus 46. The apparatus can also be configured to show that when using the same octane with and without the use of the aftermarket apparatus 46, the performance of the engine is significantly different.

Figure 2:
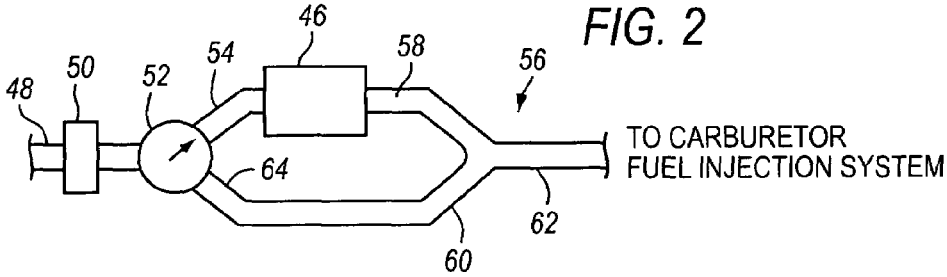
FIG. 2 is a partial view of one switching arrangement for switching aftermarket apparatus into and out of operation with respect to the engine.

With the arrangement shown in FIG. 2, the fuel switch 52 can be operated to a first position to couple the fuel from the fuel tank through the fuel conditioner 46 to the carburetor 26, or switched to a second position where the fuel from the fuel tank bypasses the fuel conditioner 46 and is coupled directly to the carburetor 26. When switched between the two positions, the fuel is either conditioned or not conditioned. The observer can thus view the gauges which show the engine performance parameters and be made visually aware of the difference made by the aftermarket apparatus 46. For example, when the switch is in the second position bypassing the fuel conditioner 46, the observer can see from the gauges on the panel 30 the hydrocarbon content and nitrogen oxides emitted by the engine 10. Then, the fuel switch 52 can be switched to the first position to cause fuel to be directed through the fuel conditioner 46, whereupon the observer can then see the new engine performance parameters on the gauges and compare the differences. The electronics can include a programmed processor for presenting the differences made in the engine performance parameters with and without the aftermarket apparatus 46. For example, the processor can be programmed to receive the before and after engine performance parameters and provide a subtraction to find the difference. The difference can then be displayed by the processor to show the difference in the readings. The before and after readings can be obtained in conjunction with a variations of the operation of the engine apparatus.

For example, the aftermarket apparatus 46 can be switched in and out of operation, with the catalytic converter 44 both in operation and bypassed by the exhaust switch 42. Four different readings can be obtained. Separately, or in conjunction with the use of the catalytic converter 44, the aftermarket apparatus 46 can be switched in and out of operation as a function of the load provided by the hydraulic load 28. The hydraulic load 28 can be of the type to place different loads on the engine 10. In combination with the various engine apparatus switched in or out of operation, the RPM of the engine 10 can be varied to also accentuate or show the difference made by the aftermarket apparatus 46. Other engine apparatus can be switched into or out of operation, such as an oxygen sensor for sensing the oxygen content in the exhaust gasses. With the oxygen sensor out of operation, the carburetor or fuel injection system cannot operate in a closed loop manner to regulate the fuel mixture and obtain the operating parameters desired by the engine manufacturer. This latter arrangement may cause the intentional emissions of pollutants from the engine 10, and the effectiveness of the aftermarket apparatus 46 in minimizing the pollutants.

The fuel line configuration of FIG. 2 can be modified to provide a third branch, rather than two branches as shown. In the third branch there can be switched into or out of operation the aftermarket apparatus of a competitor. In this event, the switch 52 or valve would have to have three output ports rather than two output ports as shown. With this arrangement, the switched arrangement of the fuel to the various branches can demonstrate the difference in operation of the engine as a function of the different aftermarket apparatus.

The various readouts, whether it be gauges or bar-type graph readouts, can be marked to show the local limits for acceptable emission of pollutants. Depending on the type of aftermarket apparatus being used, the observer can see that when bypassing the aftermarket apparatus 46, the emitted pollutants are unacceptable, and when the aftermarket apparatus 46 is switched into operation the pollutants are reduced to acceptable limits.

In the event that gas mileage is the beneficial advantage of the aftermarket apparatus 46, then the fuel flow rate is the performance parameter of interest. As noted above, the rate of fuel flow is measured by the sensor 50 and the indication thereof is coupled to the readout 34. The fuel flow reading can be obtained before and after the switched operation of the aftermarket apparatus 46. If increased mileage (reduced fuel flow) is the advantage of the aftermarket apparatus 46, then for the same operating conditions of the engine 10, the fuel flow rate should be reduced when the aftermarket apparatus 46 is switched into operation. The difference in the fuel flow rate of the engine 10 can be measured as a function of engine RPM, or load, or both.

As described above, the fuel flow rate is indicated on the gauge 34, preferably in gallons per hour. The programmed processor in the electronics can be further programmed to calculate the dollar savings in fuel as a function of the mileage driven, and as a function of the average cost per gallon of the fuel. This savings can be displayed on a readout located on the panel 30. Moreover, the programmed processor can be programmed to calculate and display the number of miles that must be driven, based on an average cost of fuel per gallon, to recover the cost of the aftermarket apparatus 46. As an alternative, a keypad can be provided for observers to input the cost of fuel per gallon, and the present miles per gallon obtained by their vehicles, in order to be provided the number of miles they must drive in order to recover the cost of adding the aftermarket apparatus 46 to their vehicle.

In accordance with a further visual effect provided by the demonstration unit of the invention, portions of the fuel lines can be made transparent, and a spinning vane or propeller mounted therein to show the flow of fuel therein. In other words, the observer can visually see that when the fuel line switch 52 is activated, the fuel in one of the branched lines is not flowing, while the fuel in the other branch is indeed flowing. For a further visual effect, the in/out operation of the aftermarket apparatus 46, the catalytic converter 44 or the load 28 can be indicated by colored lights. As an example, a light of one color can be mounted in association with the fuel line branch 54, and a light of a different color mounted in association with the fuel line branch 64. This aspect visually shows when the aftermarket apparatus is switched into or out of operation. The before/after visual readouts of the gauges can be similarly associated with colors to correspond to in/out operation of the aftermarket apparatus 46.

As noted above, a programmed processor can be employed to receive the engine performance parameters and present the same on a visual display. The programmed processor can also be used to control the various valves and operating apparatus of the engine 10 to provide an automatic configuration of the engine 10 for operation under predefined conditions. For example, the fuel valve 52 can be electrically controlled, as can the electrolytic converter valve 42 and the clutch for the operating the hydraulic load 28. Moreover, the throttle can be electrically controlled to automatically operate the carburetor or fuel injection system to obtain a certain engine speed.

Figure 3:
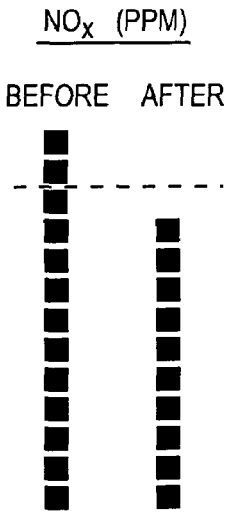
FIG. 3 illustrates a dual visual readout of an engine performance parameter before and after the operation of the aftermarket apparatus.

The control panel 30 can be equipped with a number of manually operated switches which, when pressed, will be sensed by the programmed processor. In response to the switch inputs from the panel 30, the programmed processor would operate the valves and other engine apparatus to place the engine 10 in a configuration associated with the manual switch pushed by the observer. For example, one push button switch may indicate an engine configuration with different loads at different RPMs, with and without the use of the aftermarket apparatus 46. When pushed, the programmed processor would initially switch the fuel valve 52 to couple fuel to the output port 64, thereby bypassing the aftermarket apparatus 46. The processor would adjust the throttle to a first position to achieve a desired RPM, and the clutch would be controlled by the processor to connect the hydraulic load to the engine 10. Once the engine 10 operation has stabilized, the processor would receive the data corresponding to the engine parameters. The engine parameters, such as $NO_X$, would be displayed on the "before" portion of the bar graph display (FIG. 3). The dotted line may identify the dividing line where the performance parameter is acceptable and not acceptable. After the engine operation parameters were displayed on the appropriate displays of the panel 30, the processor would reconfigure the engine 10 to switch the fuel switch 52 to switch the fuel so that it bypasses the aftermarket apparatus 46 and route the fuel directly to the carburetor 26 or fuel injection system. Once the engine operation parameters have stabilized under the new engine configuration, the processor receives the engine operation parameters and displays the same on the gauges of the panel 30. The bystanders can then visually see the different engine parameters as a function of the use and non-use of the aftermarket apparatus 46. On a periodic basis, the processor can cycle through the same routine again to repeat the foregoing. The various push buttons can cause the processor to carry out different routines to produce different engine configurations for operation under different conditions. In each configuration, the before and after results can be displayed on the gauges of the panel 30.

While the disclosed embodiment describes the use of needle-type gauges or bar graph type gauges, those skilled in the art can use many different types of visual displays for displaying the results of the use and non-use of the aftermarket apparatus 46. Computer monitors, plotters and printers can be used, as well as other computer controlled visual displays.

Figure 4:
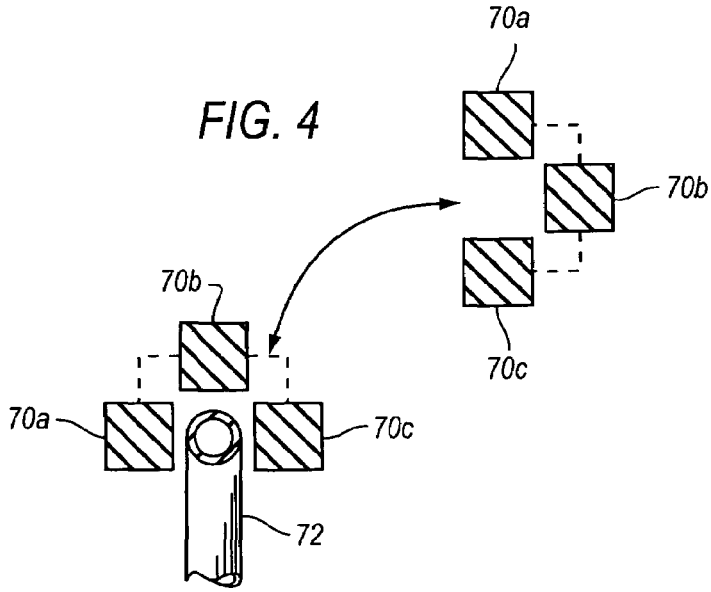
FIG. 4 graphically depicts a three-part magnet moved into proximity and out of proximity of a fuel line.

A fluid valve is disclosed in FIG. 2 as a switch for switching the aftermarket apparatus 46 into and out of operation. In another embodiment of a switchable arrangement, there is disclosed in FIG. 4 a magnet assembly including three magnets 70*a*, 70*b* and 70*c* movable from a first position in which the magnetic field of the magnets 70*a*-70*c* does not influence the fuel carried by the fuel line 72, to a second position in which the magnets 70*a*-70*c* encircle the fuel line 72. In the second position of the magnets 70*a*-70*c*, the magnetic field thereof influences the fuel in the fuel line 72 to thereby enhance the performance of the engine 10. The mechanism for holding the magnets 70*a*-70*c* can be made movable between the first and second positions either manually or automatically under control of the processor.

The engine can be used to demonstrate numerous different types of aftermarket apparatus 46. One aftermarket apparatus shown in FIG. 5 comprises a magnet assembly 80 that is well adapted for use with the demonstration engine of the invention. Here, a high intensity magnet 82 comprises a bar magnet with a high flux intensity. The magnet 82 is held by a metallic bracket 84, with upturned ends 86 for containing the magnet 82 therein. The bracket 84 also includes wings 88 and 90 with holes 92 for bolting to other like-made magnetic assemblies. Such type of magnetic assemblies are marketed as EnergyCel™ magnetic assemblies by FreEnergy Group, Inc. Three such magnetic assemblies 80 are bolted together around a fuel line 72 so that the magnetic field produced by the magnets 82 influences the molecules of the fuel. Such magnetic assemblies 80 are advertised to improve gas mileage as well as reduce pollutants emitted by internal combustion engines.

Figure 6:
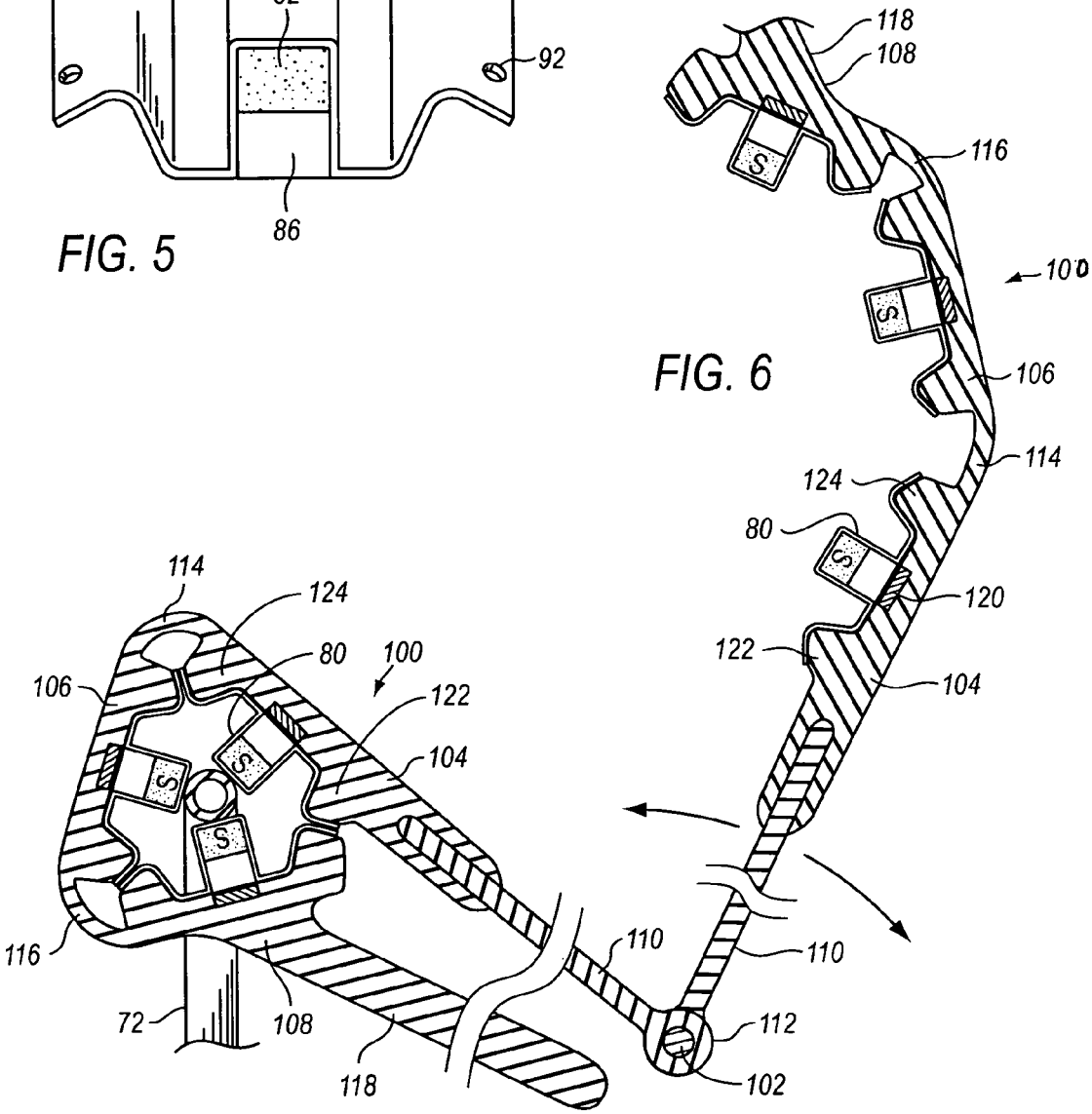
FIG. 6 is a cross-sectional view of a manually operable switching mechanism for temporarily applying a three-part aftermarket apparatus around a fuel line.

FIG. 6 illustrates another embodiment of a switch mechanism 100 for moving the three magnet assemblies 80*a*, 80*b* and 80*c* into and out of proximity to a fuel line 72. The switch mechanism 100 is pivotal about an axle 102 from a first position shown at the right of FIG. 6, to a second position shown to the left and encircling the fuel line 72. The switch mechanism 100 is constructed of a moldable material having three sections 104, 106 and 108. The base section 104 has molded therein a metallic bar 110 with a loop 112 through which an axle rod passes. The mid-section 106 is connected the base section 104 and the end section 108 via living hinges 114 and 116. The end section 108 has molded thereto a handle 118 for manual operation of the switch mechanism 110 between the two positions. The handle can be latched to the metallic bar 110 by a latch mechanism (not shown). The latch mechanism can be a wire bail hinged to the metallic bar 110 and engaged around the handle when swung to the second position. Many other latch mechanisms can be used, including the type that is molded together with the switch mechanism 100.

Each segment includes embedded therein a metal plate, such as plate 120 formed in base section 104. The embedded metal plate 120 functions to hold the magnet assembly 80 thereto due to the magnetic attraction between the magnet 82 and the metal plate 120. Each segment 104, 106 and 108 are molded to further include a pair of projections 122 and 124 that fit into the cupped troughs of the wings 88 and 90 of the magnet assemblies 80. The projections 122 and 124 function to center the magnet assemblies in the respective segments of the switch mechanism 100. With this arrangement, the magnetic assemblies 80 can be easily attached to the switch assembly 100 when in the first position where the switch mechanism 100 is opened, as shown in the right portion of FIG. 6. Once the magnet assemblies are attached to the switch mechanism 100, the mechanism can be moved via its handle 118 to the second position where the magnets 82 are adjacent the fuel line 72, and encircle the same. In order to facilitate the use of the switch mechanism 100, the fuel line 72 is preferably formed with a straight section that is spaced away from other apparatus so as not to interfere with the movement of the handle 118.

The switch mechanism 100 is articulated by the use of living hinges 114 and 116. In the event that the living hinges deteriorate due to frequent use, the entire switch mechanism 100 can be replaced. To that end, the switch mechanism 100 is disposable. The switch mechanism 100 can be constructed with other types of hinge devices molded out of the moldable material, or with metal hinges molded in the moldable material. The switch mechanism 100 can be molded using a conventional plastic material well known by those skilled in the art. In addition, the magnet assemblies 80 can be temporarily attached to the respective segments 104, 106 and 108 of the switch mechanism 100 by techniques other than using the embedded metal plates 120. For example, the magnet assemblies 80 can be temporarily attached to the respective segments by using plastic projections which protrude through one or more of the holes 92 of the metal wings of the magnet assemblies 80. Double-sided tape can be used between the segments and the magnet assemblies 80 to provide a temporary attachment therebetween. The metallic plates 120 can be substituted by the use of magnetized polymer strips with a magnetic pole opposite that of the face of the magnet 82 adjacent thereto. Many other temporary attachment mechanisms can be employed.

While the switch mechanism 100 is shown manually operated, the mechanism 100 can be made to be operable automatically. Moreover, a solenoid or motor drive apparatus (not shown) can be used to automatically move the three magnet assemblies 80 into proximity to the fuel line 72. Three corresponding mandrels can be automatically moved in and out in a radial direction with respect to the horizontal part of the fuel line 72. The mandrels can have shoes made of a desired material and shaped to conform to the shape of the magnet assemblies 80 for self-centering the magnet assemblies 80 to the shoes. The shoes can be shaped and constructed much like the segments 104, 106 and 108 of the switch mechanism 100 shown in FIG. 6. Once the magnet assemblies are loaded onto the respective shoes, the switch mechanism can be activated to move the mandrels toward the fuel line 72 into contact or proximity thereto.

The mandrels can also be constructed for lateral or vertical movement over a folded portion of a fuel line. The folded fuel line forms a stub. In other words, a fuel line folded tightly onto itself can be formed to project vertically or horizontally. A multi-part magnet assembly can be moved manually or by the use of an electrical motor into proximity with the folded fuel line by encircling the same.

Figure 5:
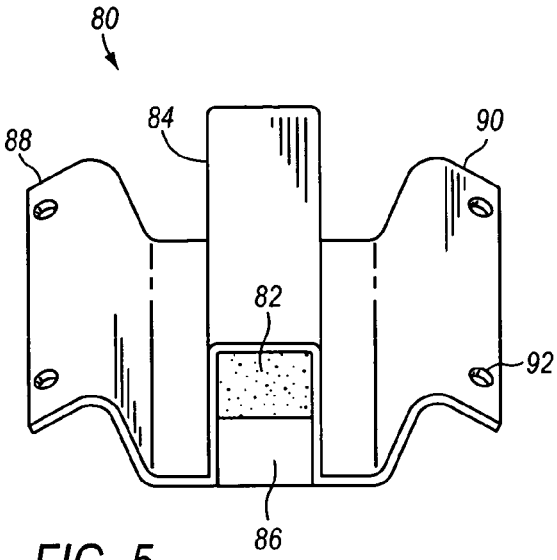
FIG. 5 is an isometric view of a magnet assembly adapted for use with the invention.

The utilization of the principles and concepts of the invention do not depend on the configuration of magnet assemblies shown in FIG. 5. Rather, many other magnet shapes and configurations can be used. It is possible to utilize a single magnet with a bore or hole therein for movement over a folded fuel line, and axially away from the folded fuel line. In another fuel line configuration, the fuel line may have a non-ferrous portion, and a ferrous portion. The magnet with a bore therein can be moved over either portion of the fuel line to either produce the desired effect on the fuel molecules by the magnetic field, or prevent the effect from occurring when moved over the ferrous portion of the fuel line.

Magnet configurations having a body with a slot therein can be used for moving the magnet slot over the fuel line in proximity to the fuel passing therethrough. In this configuration, as well as one or more configurations described above, the fuel line itself may be made movable and the magnet(s) made stationary. Two magnets can be formed, each with a semicircular elongated slot formed therein. The magnets are then brought together so that a circular bore is formed, with the fuel line extending therethrough.

While permanent magnets are disclosed for use in influencing the molecules of the fuel carried in a fuel line, one or more electromagnets may be utilized as well. The electromagnets can each have a metal core around which the electrical windings are wound. The core(s) forms the respective magnetic poles that are placed adjacent the fuel line. The magnetic pole(s) can be oriented in much the same manner as shown in FIG. 6, where the south poles of each magnet are made to be adjacent the fuel line 72. The current passing through the winding(s) of the electromagnet(s) determines the strength of the magnetic field produced. A DC current can produce a magnetic field of a nonvarying type. Different magnitudes of currents can be switched through the winding (s) to produce different influences of the magnetic field on the molecules of fuel. When it is desired to achieve a maximum influence, then a large current can be switched through the winding(s) of the electromagnets to produce a maximum effect on the fuel molecules.

In practice, the switching of different magnitudes of current through the winding(s) of the electromagnet(s) may be employed during different periods of engine operation. For example, when an automobile is at a stop light and the engine is idling and many pollutants are produced as a result of the low engine RPM, then the current through the electromagnet coil(s) may be automatically increased to increase the effect of the magnetic field on the fuel molecules and reduce the pollutants emitted by the engine exhaust. This same principle can be used to determine those periods of time when the maximum engine pollutants are being created, and the on-board computer of the automobile or vehicle be made sensitive to such period of operation, and cause the magnetic field to be increased to thereby reduce the pollutants. The on-board automobile computer can sense engine RPM and speed, as well as other engine or automobile performance parameters, and determine when the magnetic influence should be adjusted to counteract the pollutants produced by the engine.

In addition, the on-board computer of the automobile may be programmed to respond to certain times of the day to reduce pollutants by varying the magnetic field influencing the fuel. For example, during morning rush hour and evening rush hour periods of heavy traffic, where many automobiles are on the roads, the pollutants may be further reduced by automatically increasing the current through the electromagnetic windings and thus provide better engine combustion and less pollutants. During times when the vehicle is pulling heavy loads, and where the engine may be operating in a less than efficient manner, the on-board computer can be programmed to sense the same and adjust the magnet winding current and thus the influence of the magnetic field on the fuel molecules.

Figure 7:
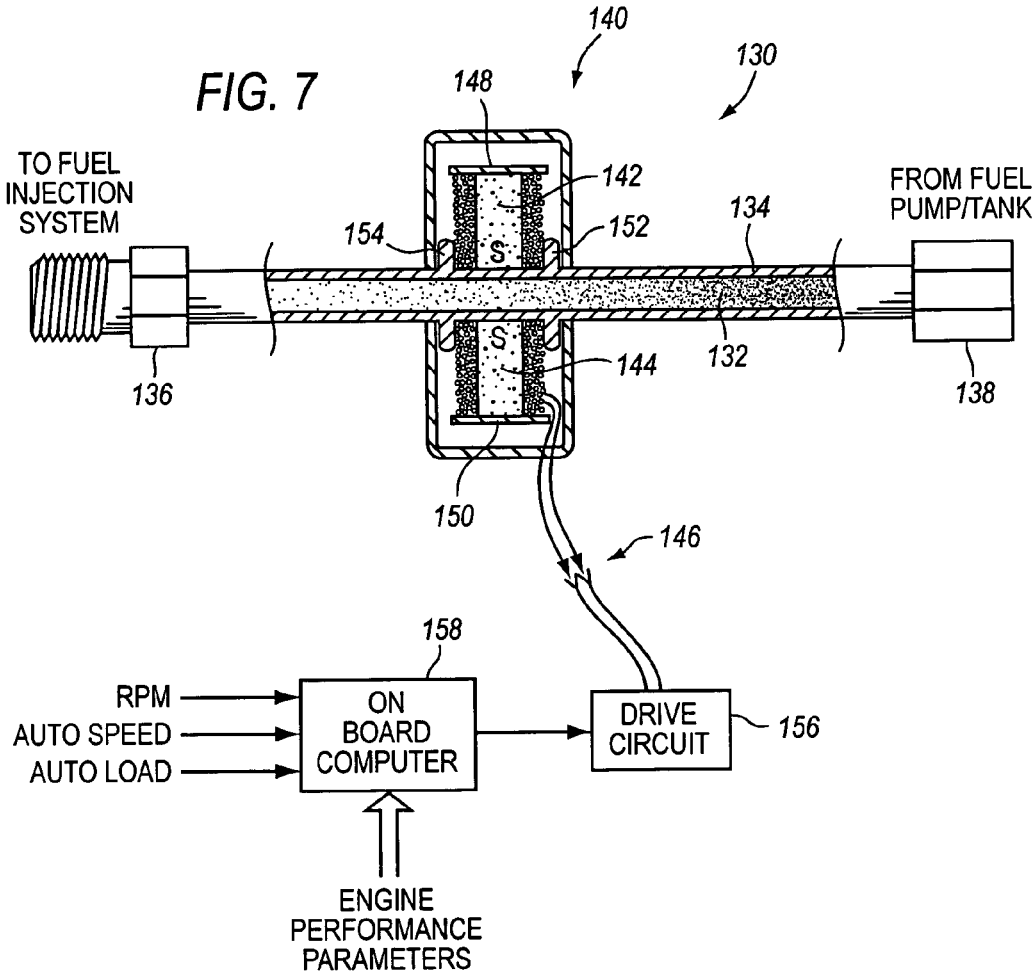
FIG. 7 is s partial cross-sectional view of an aftermarket apparatus for generating a magnetic field using electromagnets.

FIG. 7 illustrates an electromagnet configuration 130 that is constructed to provide a magnetic field influence on the molecules 132 of the fuel passing through a fuel line section 134. The aftermarket apparatus 130 is constructed so that it can be installed between the fuel injection system or carburetor and the existing fuel line of the engine. To that end, a section of fuel line 134 is constructed from a non-ferrous or synthetic tubular material and fitted on each end with a standard brass male connection 136 and female connection 138. A two-pole electromagnet 140 if constructed so that a first magnet core 142 and a second core 144 has ends that are positioned adjacent the fuel line 134. Wound around both cores 142 and 144 is a conductor having two terminal ends 146. The winding direction of the wire is such that the same magnetic pole exists adjacent the fuel line 134. Each core is associated with a bobbin 148 and 150 around which the wire is wound. Stops 152 and 154 may be formed on the fuel line 134 to maintain an axial position of the electromagnet 140 on the fuel line 134.

The winding of the electromagnet 140 is connected to a current drive circuit 156. The drive circuit 156 is preferably of the type for providing different current magnitudes of DC current to the electromagnet 140. Those skilled in the art can easily design current drive circuits for inductive loads, where the drive circuits are responsive to different analog or digital inputs for driving the winding of the electromagnet 140 with different currents. The on-board computer 158 of the vehicle is coupled to the drive circuit 156. The computer 158 is also coupled to various vehicle performance parameter sensors, such as RPM, speed, load, and other performance parameters used to determine the magnitude of current that should be used to drive the electromagnet 140, as a function of the performance state of the vehicle.

While the preferred and other embodiments of the invention have been disclosed with reference to specific engine performance devices, it is to be understood that many changes in detail may be made as a matter of engineering choices without departing from the spirit and scope of the invention, as defined by the appended claims. In addition, not all of the features and advantages of the invention need be employed to realize the individual aspects thereof. Accordingly, those skilled in the art may find that various of the aspects of the invention may form a combination that provides advantages in particular applications.

What is claimed is:

1. An engine performance demonstration unit, comprising:

a mobile carrier;

an engine mounted to said mobile carrier;

a magnet for use with said engine to modify the properties of fuel to be combusted by said engine and thereby affect the operation of said engine; and a switch mechanism for switching said magnet into operation and out of operation so that the fuel coupled to the engine has modified properties when said magnet is switched into operation, and the fuel coupled to the engine does not have modified properties when said magnet is switched out of operation, said engine remains running irrespective of whether the magnet is switched into operation or out of operation.

2. The engine performance demonstration unit of claim 1, further including a visual display for visually showing the difference in engine operation when the magnet is operational and nonoperational.

3. The engine performance demonstration unit of claim 2, wherein said visual display comprises two visual displays, one visual display showing an engine performance parameter when the magnet is not operational, and a second visual display showing the engine performance parameter when the magnet is operational.

4. The engine performance demonstration unit of claim 2, wherein said visual display displays a flow rate of fuel to said engine.

5. The engine performance demonstration unit of claim 2, wherein said visual display displays a parameter related to a pollutant emitted by said engine.

6. The engine performance demonstration unit of claim 1, not including a heater associated with a fuel line for heating the fuel.

7. The engine performance demonstration unit of claim 1, wherein said switch mechanism comprises a valve for switching fuel.

8. The engine performance demonstration unit of claim 1, wherein said switch mechanism comprises an articulated mechanism for holding a plurality of magnet assemblies, said articulated mechanism is hinged for operation for moving said magnet assemblies into and out of magnetic influence with a fuel line.

9. The engine performance demonstration unit of claim 8, wherein said articulated mechanism includes a plurality of segments, each segment for attachment thereto of a respective magnet assembly, and each segment hinged to an adjacent segment by a hinge.

10. The engine performance demonstration unit of claim 1, wherein said articulated mechanism comprises a carrier for holding said magnet is in a position spaced apart from a fuel line and thus does not influence the fuel in said fuel line, and wherein said carrier is movable to a position wherein said magnet is adjacent said fuel line.

11. The engine performance demonstration unit of claim 10, wherein said magnet comprises a three-part magnet, each said magnet held in a respective metal frame.

12. The engine performance demonstration unit of claim 1, further including a branched fuel line comprising a valve for switching fuel to either of two branches, one branch having said magnet is coupled therein, and the other branch coupling fuel from said valve to said engine.

13. The engine performance demonstration unit of claim 1, further including a catalytic converter switched into and out of operation with respect to exhaust gasses of the engine.

14. The engine performance demonstration unit of clain 1, further including a load that is switchable into and out of operation with respect to said engine, said load providing a resistance to torque produced by said engine.

15. The engine performance demonstration unit of claim 1, wherein said mobile carrier comprises a wheeled trailer to which said engine is mounted for mobile movement, said wheeled trailer adapted for being pulled by a vehicle over a highway.

16. The engine performance demonstration unit of claim 1, further including a programmed processor for controlling said switch mechanism for switching said one or more magnets into and out of operation.

17. The engine performance demonstration unit of claim 1, further including a programmed processor for monitoring engine performance parameters before said magnet has been switched into operation and after said magnet has been switched into operation, and providing a visual display of said parameters.

18. The engine performance demonstration unit of claim 17, wherein said programmed processor stores the engine performance parameters and provides a visual display of the stored parameters.

19. The engine performance demonstration unit of claim 18, wherein said programmed processor is programmed to display an engine performance parameter on a first display resulting from the magnet switched out of operation, and simultaneously display on a second display the engine performance parameter resulting from the magnet switched into operation.

20. The engine performance demonstration unit of claim 18, wherein said programmed processor is programmed to store an engine performance parameter when the magnet is switched into operation, and programmed to store the engine performance parameter when the magnet is switched out of operation, and programmed to calculate and display a difference between said engine performance parameter stored when the magnet is switched into operation and the engine performance parameter stored when the magnet is switched out of operation.

21. A method of demonstrating the affect of aftermarket apparatus on the performance of an engine, comprising the steps of:

providing a mobile carrier adapted for transport on a highway;

providing the mobile carrier for carrying said engine;

providing aftermarket apparatus mounted to the engine to modify the properties of fuel to be combusted by said engine, where said aftermarket apparatus is not apparatus that heats the fuel when in a liquid form; and providing a switch mechanism for switching the aftermarket apparatus into and out of operation so that the fuel coupled to the engine has modified properties when said aftermarket apparatus is switched into operation, and the fuel coupled to the engine does not have modified properties when said aftermarket apparatus is switched out of operation, said engine remains running irrespective of whether the aftermarket apparatus is switched into operation or out of operation, and providing an indication of the affect thereof on the engine performance.

22. A method of demonstrating the affect of magnets on the performance of an engine, comprising the steps of:

providing a mobile carrier;

providing the mobile carrier for carrying said engine;

providing one or more magnets to influence molecules of fuel fed to said engine;

providing a switch mechanism for switching the one or more magnets into and out of operation while the engine is operating to thereby provide an indication of the affect thereof of the one or more magnets on the engine performance; and providing a visual indication during engine operation of the affect of the one or more magnets on the engine performance.

* * * * *